US007638957B2

(12) United States Patent
Chen

(10) Patent No.: US 7,638,957 B2
(45) Date of Patent: Dec. 29, 2009

(54) SINGLE DRIVE BETATRON

(75) Inventor: Felix Chen, Newton, CT (US)

(73) Assignee: Schlumberger Technology Corporation, Cambridge, MA (US)

( * ) Notice: Subject to any disclaimer, the term of this patent is extended or adjusted under 35 U.S.C. 154(b) by 191 days.

(21) Appl. No.: 11/957,178

(22) Filed: Dec. 14, 2007

(65) Prior Publication Data

US 2009/0153279 A1 Jun. 18, 2009

(51) Int. Cl.
*H05H 11/00* (2006.01)

(52) U.S. Cl. ..... 315/504; 250/269.3; 335/296

(58) Field of Classification Search ..... 250/253–266; 315/500–505; 335/296
See application file for complete search history.

(56) References Cited

U.S. PATENT DOCUMENTS 2,103,303 A * 12/1937 Steenbeck ..... 315/504
2,394,070 A * 2/1946 Kerst ..... 315/504
2,447,255 A 8/1948 Kerst et al
2,473,123 A * 6/1949 Adams, Jr ..... 315/504
2,528,525 A * 11/1950 Langmuir et al. ..... 315/504
2,528,526 A * 11/1950 Westendorp ..... 315/504
2,533,859 A * 12/1950 Wideroe ..... 315/504
2,538,718 A * 1/1951 Wideroe ..... 315/504
2,540,853 A * 2/1951 Wilkinson et al. ..... 315/504
2,558,597 A * 6/1951 Westendorp ..... 315/504
2,572,414 A * 10/1951 Wideroe ..... 315/504
2,572,551 A * 10/1951 Wideroe ..... 315/15
2,654,838 A * 10/1953 Wideroe ..... 315/504
2,660,673 A * 11/1953 Westendorp ..... 315/504
2,675,470 A * 4/1954 Wideroe ..... 315/504
2,698,384 A * 12/1954 Wideroe ..... 315/504
2,797,322 A * 6/1957 Von Arx ..... 315/504
3,321,625 A 5/1967 Wahl
3,614,638 A * 10/1971 Ananiev et al. ..... 315/504
3,805,202 A * 4/1974 Chakhlov et al. ..... 335/210
3,975,689 A * 8/1976 Geizer et al. ..... 315/504
3,996,473 A 12/1976 Culver
4,392,111 A * 7/1983 Rostoker ..... 315/504

(Continued)

FOREIGN PATENT DOCUMENTS

EP 0481865 A1 4/1992

OTHER PUBLICATIONS

Ellis et al., Well Logging for Earth Scientists, Springer, 2nd edition, 2007, pp. 345-379.

*Primary Examiner*—Ramon M Barrera
(74) *Attorney, Agent, or Firm*—James M. McAleenan; Jody Lynn DeStefanis; Dale Gaudier

(57) ABSTRACT

A betatron includes a betatron magnet with a first guide magnet having a first pole face and a second guide magnet having a second pole face. Both the first and the second guide magnet have a centrally disposed aperture and the first pole face is separated from the second pole face by a guide magnet gap. A core is disposed within the centrally disposed apertures in an abutting relationship with both guide magnets. The core has at least one core gap. A drive coil is wound around both guide magnet pole faces. An orbit control coil has a contraction coil portion wound around the core gap and a bias control portion wound around the guide magnet pole faces. The contraction coil portion and the bias control portion are connected but in opposite polarity. Magnet fluxes in the core and guide magnets return through peripheral portions of the betatron magnet.

28 Claims, 7 Drawing Sheets

U.S. PATENT DOCUMENTS 4,577,156 A 3/1986 Kerst
4,823,044 A 4/1989 Falce
5,077,530 A 12/1991 Chen
5,122,662 A * 6/1992 Chen et al. ..... 250/269.3
5,293,410 A 3/1994 Chen et al.
5,319,314 A 6/1994 Chen
5,426,409 A 6/1995 Johnson
5,525,797 A 6/1996 Moake
5,745,536 A 4/1998 Brainard et al.
5,804,820 A 9/1998 Evans et al.
5,912,460 A 6/1999 Stoller et al.
6,121,850 A 9/2000 Ghoshal
6,201,851 B1 3/2001 Piestrup et al.
6,441,569 B1 8/2002 Janzow
6,713,976 B1 3/2004 Zumoto et al.
6,925,137 B1 8/2005 Forman
7,148,613 B2 12/2006 Dally et al.
2006/0261759 A1 11/2006 Chen et al.

* cited by examiner

SINGLE DRIVE BETATRON

CROSS REFERENCE TO RELATED APPLICATION(S)

This patent application is related to commonly owned U.S. patent application Ser. No. 11/957,183, titled "Bi-Directional Dispenser Cathode"; Luke T. Perkins, filed on Dec. 14, 2007.

BACKGROUND OF THE INVENTION

1. Field of the Invention

This invention generally relates to a compact betatron electron accelerator. More particularly, a single coil drives both a core section and a guide field eliminating a need for, and space occupied by, separate drive coils separated by an air gap.

2. Background of the Invention

Oil well bore hole logging is a process by which properties of earth strata as a function of depth in the bore hole are measured. A geologist reviewing the logging data can determine the depths at which oil containing formations are most likely located. One important piece of the logging data is the density of the earth formation. Most present day well logging relies on gamma-rays obtained from chemical radiation sources to determine the bulk density of the formation surrounding a borehole. These sources pose a radiation hazard and require strict controls to prevent accidental exposure or intentional misuse. In addition, most sources have a long half life and disposal is a significant issue. For some logging applications, in particular determination of formation density, a $^{137}$Cs source or a $^{60}$Co source is used to irradiate the formation. The intensity and penetrating nature of the radiation allow a rapid, accurate, measurement of the formation density. In view of the problems with chemical radiation sources, it is important that chemical radiation sources be replaced by electronic radiation sources. The main advantage of the latter is that they can be switched off, when no measurement is made and that they have a minimal potential for intentional misuse.

One proposed replacement for chemical gamma-ray sources is a betatron accelerator. In this device, electrons are accelerated on a circular path by a varying magnetic field until being directed onto a target. The interaction of the electrons with the target leads to the emission of Bremsstrahlung and characteristic x-rays of the target material. Before electrons can be accelerated, they are injected into a magnetic field between two circular pole faces at the right time, with correct energy and correct angle. Control over timing, energy and injection angle enables maximizing the number of electrons accepted into a main electron orbit and accelerated.

A typical betatron, as disclosed in U.S. Pat. No. 5,122,662 to Chen et al. has a pole face diameter of about 4.5 inches. The magnet consists of two separated, magnetically isolated pieces: a core with a magnetic circuit that is a nearly closed loop and a guide field magnet that includes two opposing pole faces separated by a gap of about 1 centimeter. The pole faces that encompass the core have a toroidal shape. A gap of about 0.5 cm separates the core from the inner rims of the pole faces. The two pieces are driven by two separated sets of coils connected in parallel: a field coil wound around the outer rims of the pole faces and a core coil wound on a center section of the core. The field magnet and the core are magnetically decoupled with a reverse field coil wound on top of the core coil. Both the core coil and the reverse field coil locate in the 0.5 cm gap. U.S. Pat. No. 5,122,662 is incorporated by reference in its entirety herein.

In operation, a typical betatron satisfies the betatron condition and accelerates electrons to relativistic velocity. The betatron condition is satisfied when:

$$\Delta\phi_0 = 2\pi r_0^2 \Delta B_{y,0} \quad (1)$$

where:

$r_0$ is the radius of a betatron orbit located approximately at the center of the pole faces;

$\Delta\phi_0$ is the change of flux enclosed within $r_0$; and $\Delta B_{y,0}$ is the change in guide field at $r_0$.

The betatron condition may be met by adjusting the core coil to guide field coil turn ratio as disclosed in U.S. Pat. No. 5,122,662. Satisfying the betatron condition does not insure the machine will work. Charge trapping, injecting electrons into the betatron orbit at the optimal point of time, is another challenging operation. In the 4.5 inch betatron, this is accomplished by holding the flux in the core constant while increasing the guide field. It can be done because the core and guide field are driven independently.

Large betatrons are suitable for applications where size constraints are not critical, such as to generate x-rays for medical radiation purposes. However, in applications such as oil well bore holes where there are severe size constraints, it is desired to use smaller betatrons, typically with a magnetic field diameter of three inches or less. The conventional design for large betatrons is not readily applied to smaller betatrons for a number of reasons:

(1) If the electron injector is located in the gap between pole faces, the gap height must be larger than the dimension of the injector perpendicular to the pole faces. In order to maintain a reasonable beam aperture, the width of the pole faces can not be reduced too much either. Thus, the burden of the size reduction falls mostly on the core, resulting in a significantly lower beam energy.

(2) If the electron injector is located in the gap between the pole faces, one must, within a time period comparable to the orbit period of electrons, alter the injected electrons trajectories such that they do not hit the injector. Those electrons whose trajectories do not intercept either the injector structure and the vacuum chamber walls are said to be trapped. Only trapped electrons may be accelerated to full energy and caused to impinge on the target and produce radiation. Due to the nature of the charge trapping mechanism, the probability of trapping any charge in a 3 inch machine is almost nil unless the modulation frequency of the main drive is increased to about 24 kHz (triple that of a 4.5 inch machine) and the injection energy is reduced to about 2.5 kV (½ that of the 4.5 inch machine). Even then, the prospect of trapping a charge comparable to that trapped in a 4.5 inch machine is poor.

(3) A higher flux density is required to confine the same energy electrons to a smaller radius. A higher flux density and modulation frequency results in a higher power loss in a three inch betatron, even though it has a smaller volume than a 4.5 inch betatron.

As a result of (1)-(3), it is estimated that the useable radiation output of a three inch betatron with the conventional design would be three orders of magnitude lower than the 4.5 inch betatron. There exists a need for a small diameter betatron having a radiation output comparable to the 4.5 inch betatron.

SUMMARY OF THE INVENTION

According to an embodiment of the invention, the invention includes a betatron magnet having a circular, donut shaped guide magnet, and a core disposed in the center, and abutting the guide magnet and one or more peripheral return yokes. A guide magnet gap separates the guide magnet into an upper portion and a lower portion with opposing pole faces. A drive coil is wound around the guide magnet pole faces. An orbit control coil has a contraction coil portion wound around the core and a bias control portion wound around the pole faces of the guide magnet. The contraction coil portion and the bias control portion can be connected in series but in opposite polarities. However, it is noted that the contraction coil portion and the bias control portion can be driven independently. Further, a circuit provides voltage pulses to the drive coil and to the orbit control coil. Magnetic fluxes in the core and in the guide magnet return through two peripheral portions, or return yokes, of the betatron magnet. An evacuated electron acceleration passageway disposed in the guide magnet gap contains electrons which are accelerated to a relativistic velocity and then caused to impact a target thereby generating x-rays.

Operation of this betatron includes forming a first magnetic flux of a first polarity that passes through the guide magnet, the electron acceleration passageway and the core and then returns through the return yokes, and a second magnetic flux of either the first polarity or of an opposing second polarity that passes through the core and returns through the guide magnet gap and the electron acceleration passageway. At the beginning of each cycle, a high voltage pulse (typically a few kV) is applied to the injector and causes electrons to be injected into the electron acceleration passageway. To achieve fast contraction without compromising the maximum energy the core is a hybrid core having a perimeter portion made of fast ferrite surrounding a slower, but high saturation flux density material. During the first time period most of the flux needed to reduce the radius of electron orbits flows through the fast ferrite. After this first time duration, the fast ferrite perimeter of the core magnetically saturates and the second magnetic flux then flows through the internal portion of the core and in combination with the first magnetic flux accelerates the electrons. The polarity of the second magnetic flux is reversed when the electrons approach a maximum velocity thereby expanding the electron orbit and causing the electrons to impact a target generating x-rays.

According to an aspect of the invention, the invention can include the core as being a hybrid having a high saturation flux density central portion and a perimeter formed from a fast response highly permeable magnetic material. Further, the central portion can be an amorphous metal and the perimeter can be a ferrite with a magnetic permeability in excess of 100. Further still, the invention can include a cumulative width of the at least one core gap that is effective to satisfy a betatron condition. It is possible the invention can include the cumulative width of the at least one core gap to be approximately between 2 millimeters and 2.5 millimeters. Further, the invention can include the at least one core gap to be formed of multiple gaps. Further still, the invention can include diameters of both the first pole face and the second pole face that are approximately between 2.75 inch and 3.75 inch. It is also possible the invention can include a ratio of the contraction coil portion windings to the bias control portion windings to be 2:1. Further, the invention can include a ratio of the drive coil windings to the bias coil windings to be at least 10:1 and the number of drive coil windings to be at least 10. Further still, the invention can include a circuit providing a nominal peak current of 170 A and a nominal peak voltage of 900V. It is also possible the invention can include affixed to a sonde effective for insertion into an oil well bore hole.

According to an embodiment of the invention, the invention can include a method to generate x-rays. The method can include the steps of providing a betatron magnet that includes a first guide magnet having a first pole face and a second guide magnet having a second pole face. Further, both the first guide magnet and the second guide magnet can have a centrally disposed aperture, wherein the first pole face is separated from the second pole face by a guide magnet gap. Further the method can include the steps of a core disposed within the centrally disposed apertures, in an abutting relationship with both the first guide magnet and the second guide magnet. Further, the core can have at least one core gap that includes circumscribing the guide magnet gap with an electron passageway. Further, the method includes the steps of forming a first magnetic flux of a first polarity to an opposing second polarity that passes through central portions of the betatron magnet and the core as well as through the electron passageway and then returns through peripheral portions of the betatron magnet. The method further includes the steps of injecting electrons into an electron orbit within the electron passageway when the first magnetic flux is at approximately a minimum strength at the first polarity. Further, the method includes the steps of forming a second magnetic flux at the opposing second polarity that passes through a perimeter of the core and returns through the electron passageway in a first polarity for a first time effective to compress the injected electron orbits to an optimal betatron orbit. The method also includes the steps of after the first time the perimeter of the core magnetically saturates and the second magnetic flux passes through an interior portion of the core and in combination with the first magnetic flux, accelerates the electrons whereby enforcing a flux forcing condition. The method further includes the steps of reversing the polarity of the second magnetic flux when the first magnetic flux approached a maximum strength thereby expanding the electron orbit causing the electrons to impact a target causing an emission of x-rays.

The disclosed betatron is compact and is suitable for attachment to a sonde for lowering into an oil well bore hole. The products of interaction of the generated x-rays with ground formations are useful for a geologist to determine characteristics of earth formations, such as density as well as likely locations of subterranean oil deposit.

Further features and advantages of the invention will become more readily apparent from the following detailed description when taken in conjunction with the accompanying Drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PREFERRED EMBODIMENTS

Figure 1:
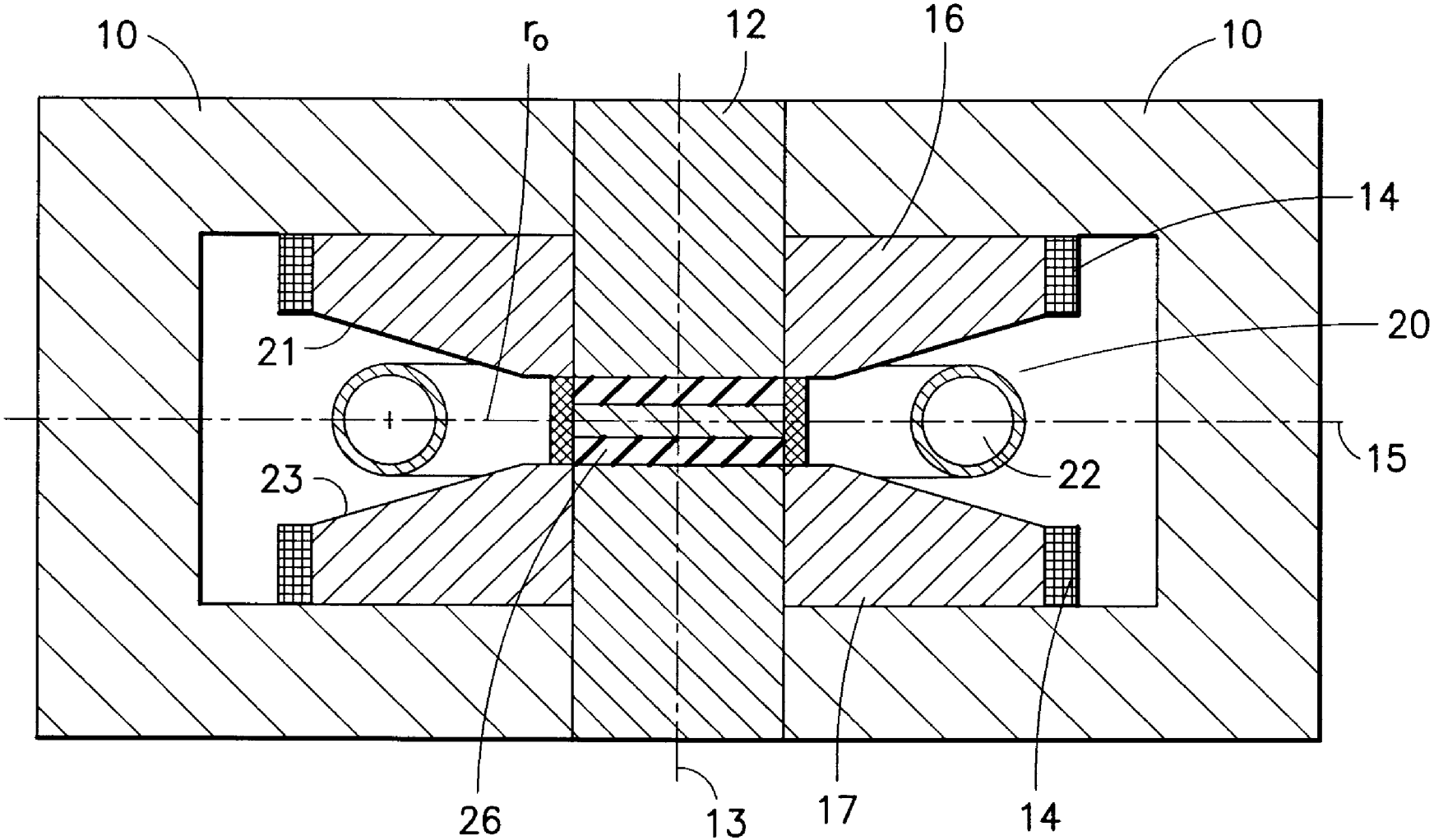
FIG. 1 illustrates in cross sectional representation the magnet configuration and drive coil of a small diameter betatron design according to an embodiment of the invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice. Further, like reference numbers and designations in the various drawings indicated like elements.

According to an embodiment of the invention, the invention includes a betatron magnet includes a circular, donut shaped guide magnet and a core disposed in the center and abutting the guide magnet, and one or more peripheral return yokes. A guide magnet gap separates the guide magnet into upper and lower portions with opposing pole faces. A drive coil is wound around the guide magnet pole faces. An orbit control coil has a contraction coil portion wound around the core and a bias control portion wound around the pole faces of the guide magnet. The contraction coil portion and the bias control portion can be connected in series but in opposite polarities. However, it is noted that the contraction coil portion and the bias control portion can be driven independently. Further, a circuit provides voltage pulses to the drive coil and to the orbit control coil. Magnetic fluxes in the core and guide magnets return through peripheral portions of the betatron magnet, which are called return yokes. An evacuated tube encompasses an electron acceleration passageway and is disposed in a space between the guide magnet pole faces. Electrons are accelerated to a relativistic velocity in this passageway and then caused to impact a target. As electrons decelerate rapidly and ionized target atoms recover from the impact and returns to a lower energy state, x-rays are emitted.

Operation of the betatron includes forming a first magnetic flux of a first polarity that passes through the guide magnet pole faces, the electron acceleration passageway and the core and then returns through the return yokes, and forming a second magnetic flux of either the first polarity or of an opposing second polarity that passes through the core and returns through the guide magnet pole faces and the electron acceleration passageway.

At the beginning of each cycle, a high voltage pulse (typically a few kV) is applied to an injector and causes electrons to be injected into the electron acceleration passageway. It is preferable, but not necessary, to design the shape of the injector voltage pulse such that the energy of the injected electrons increases at an appropriate rate in relationship to the rising guide magnetic field in the acceleration passageway over a period of 100 nanoseconds or more. The period during which the match condition between the injector voltage pulse and the first magnetic flux in the passageway exists is referred to as the injection window. Electrons injected within the injection window have the highest probability of being trapped. The matched condition is best described by the concept of instantaneous equilibrium orbit of radius, $r_i$. At the instantaneous equilibrium orbit the magnetic bending force is equals to the centrifugal force. At $r>r_i$, the magnetic bending force is greater whereas the opposite is true for $r<r_i$. Thus, electrons associated with a given $r_i$ are bound to $r_i$ much like a ball attached to a point through a spring. The injection window is the time period during which $r_i$ is located inside the passageway. Unlike $r_0$ which is determined by the design of the magnet and prescribes how the main drive flux (first magnetic flux) is partitioned between different parts of the magnet, $r_i$ is a function of the electron energy and magnetic field at $r_i$.

If an electron is injected at $r=r_i$ and tangent to the circle, its trajectory will follow the circle and intercept the injector in its first revolution. It is therefore preferable to inject electrons such that $r_i$ is either smaller (if the injector is located near the outside edge of the passageway) or larger (if the injector is located near the inside edge of the passageway) than the radius of injection. The trajectories of electrons injected at $r\neq r_i$ and/or at an angle to the tangent of the injection circle, r, will oscillate with respect to $r_i$ (betatron oscillation). As the first magnetic flux increases, the amplitude of the oscillation reduces and $r_i$ moves closer to $r_0$ (betatron damping). The oscillatory trajectories may cause electrons to miss the injector in the first few revolutions but electrons will eventually hit the injector unless the betatron damping is sufficiently fast or a second magnetic flux is introduced to alter $r_i$ in such a way that certain electron trajectories do not intercept the injector.

To illustrate the sequence of operation, consider an example in which the injection takes place near the outside edge of the passageway and $r_i$ lies just inside the injector structure. At the beginning of the injection window, a second magnetic flux is formed for a first time duration that passes mainly through a perimeter of the core at an opposing second polarity and returns through the electron passageway at the first polarity. The reducing flux within the core induces a deceleration electric field in the passageway, and at the same time the returning second magnetic flux through the passageway causes an increase of the magnetic field in the vicinity of electron trajectories.

The combined effect leads to a rapid contraction of $r_i$ and electron trajectories move away from the injector. For the contraction during this first time duration to be effective (i.e. contract $r_i$ by about 2 mm per revolution), the second magnetic flux in the core must build up at a very fast rate. Generally, a fast response magnetic material has a low saturation flux density insufficient to support the flux needed to accelerate electrons to the desired energy. To achieve fast contraction without compromising the maximum energy, the core is a hybrid construction with a fast ferrite perimeter surrounding a slower, but high saturation flux density interior. During the first time period most of the flux needed to reduce $r_i$ flows through the fast ferrite perimeter. After this first time duration, the perimeter magnetically saturates and the second magnetic flux then flows through the interior of the core and in combination with the first magnetic flux accelerates the electrons. The polarity of the second magnetic flux is reversed when the electrons approach a maximum velocity thereby expanding the electron orbit and causing the electrons to impact a target generating x-rays.

Among the features of a small diameter betatron described herein are: (i) the magnet consists of a single piece rather than two separated pieces and the 0.5 cm gap between magnet pieces is eliminated; (ii) a single drive coil drives both the core section and the guide magnet. The betatron condition is met by including a small gap within the center core, and (iii) an orbit control coil comprised of a small, for example two turn, winding around the core provides the flux for orbit contraction. Another one turn coil around the pole faces and can be connected in series with, but in opposite polarity to, the core winding de-couples the main drive coil from the orbit control coil, and vice versa. However, it is noted that the contraction coil portion and the bias control portion can be driven independently.

These features lead to several advantages over the two piece design, especially in small 3 inch betatrons: (i) due to the larger core area, the energy is significantly higher; (ii) the gap in the core significantly reduces the non-linearity of a closed loop core and should therefore have a reduced sensitivity to temperature. Operation in an oil field bore hole exposes the betatron magnet to operating temperatures of up to 200° C. at the center and 150° C. ambient, so the magnet and the core are manufactured from materials having curie temperatures above these expected maximums; and (iii) since charge trapping is accomplished with a mechanism which does not depend on a fast rise of the guide field to move electrons away from the injector, the main drive coil can have a high inductance. This translates into a low drive current and modulation frequency resulting in lower power consumption and better match to the injector voltage pulse profile.

FIG. 1 illustrates in a cross sectional representation a betatron magnet, which includes return yokes 10, first guide magnet 16 and second guide magnet 17 encircling a magnetic core 12. Both guide magnets 16, 17 and the core 12 have substantial radial symmetry about longitudinal axis 13, and mirror symmetry about a mid plane 15. The guide magnets 16, 17 are formed from a soft magnetic material, such as MND5700 ferrite manufactured by Ceramic Magnetics, Inc. of Fairfield, N.J., having a high permeability, such as about 2000, to readily conduct a magnetic flux. Due to the one or more gaps 26 in the magnetic core 12, the magnetic permeability of the betatron magnet has little effect on the magnetic properties that accelerate and direct the electrons, as long as the permeability is sufficiently high, such as about 2000. The gaps 26 may be air gaps or spacers formed from a non-magnetic material and non-conductive. The return yokes 10 may be formed from a magnetic material such as ferrite or, similar to the core described below as a hybrid having both an amorphous metal and a ferrite component.

Still referring to FIG. 1, the magnetic core 12 is described below and may be a composite having a high saturation flux density interior and a fast but lower saturation flux density periphery, or vice versa. Main drive coil 14 is wound around both guide magnets 16, 17 in an interior portion of the betatron magnet. Typically, but not necessarily, the main drive coil 14 will have ten or more windings to reduce power consumption and have a suitable first magnetic flux rise time in relationship to the injector pulse rise time. Activation of the main drive coil 14 creates magnetic flux that confines and accelerates electrons contained within passageway 20. Passageway 20 is a region in space between the pole faces 21, 23 of the guide magnets. Stable instantaneous equilibrium electron orbits and focusing conditions of electrons exist within the confines of the passageway 20.

FIG. 1 shows contained within the passageway 20 a toroid shaped tube 22 formed from a low thermal expansion glass or ceramic whose interior surfaces are coated with a suitable resistive coating, such as 100-1000 holms per square centimeters. When grounded, the coating prevents excessive surface charge buildup, which has a detrimental effect on the circulating electron beam. During betatron operation, the interior volume of the tube 22 is under a vacuum of about $1\times10^{-8}$ torr to about $1\times10^{-9}$ torr to minimize electron loss from collisions with residual gas molecules. The interior volume of the tube 22 overlaps the passageway 20 in such a way that stable instantaneous orbits do not intercept the tube wall.

To satisfy the betatron condition and accelerate electrons to relativistic velocity, the following condition must be satisfied.

$$\Delta\phi_0=2\pi r^2_0\Delta B_{y0} \tag{1}$$

where:

$r_0$ is the radius of an optimal betatron orbit located approximately at the center of the pole faces of the guide magnet;

$\Delta\phi_0$ is the change of flux enclosed within $r_0$; and $\Delta B_{y0}$ is the change in guide field at $r_0$.

The betatron condition between $\Delta\phi_0$ and $\Delta B_{y0}$ is met by properly choosing the cumulative width of the one or more core gaps 26. The core gaps 26 may be air gaps or filled with non-metallic, non-magnetic material having a melting temperature in excess of the operating temperature that for borehole operations is about 150° C. Suitable materials for the gap are polytetrafluroethylene and similar polymers. The cumulative width of the one or more gaps sets the magnetic reluctance for the core 12 and determines the relative amount of flux that passes through the core 12 and the passageway 20. The larger the cumulative width of the gap, the more flux that passes through the passageway. For a three inch pole face diameter and an average magnet gap height of about 1 cm in the passageway, the core gap 26 has a cumulative width of about 2.5 mm.

Figure 2:
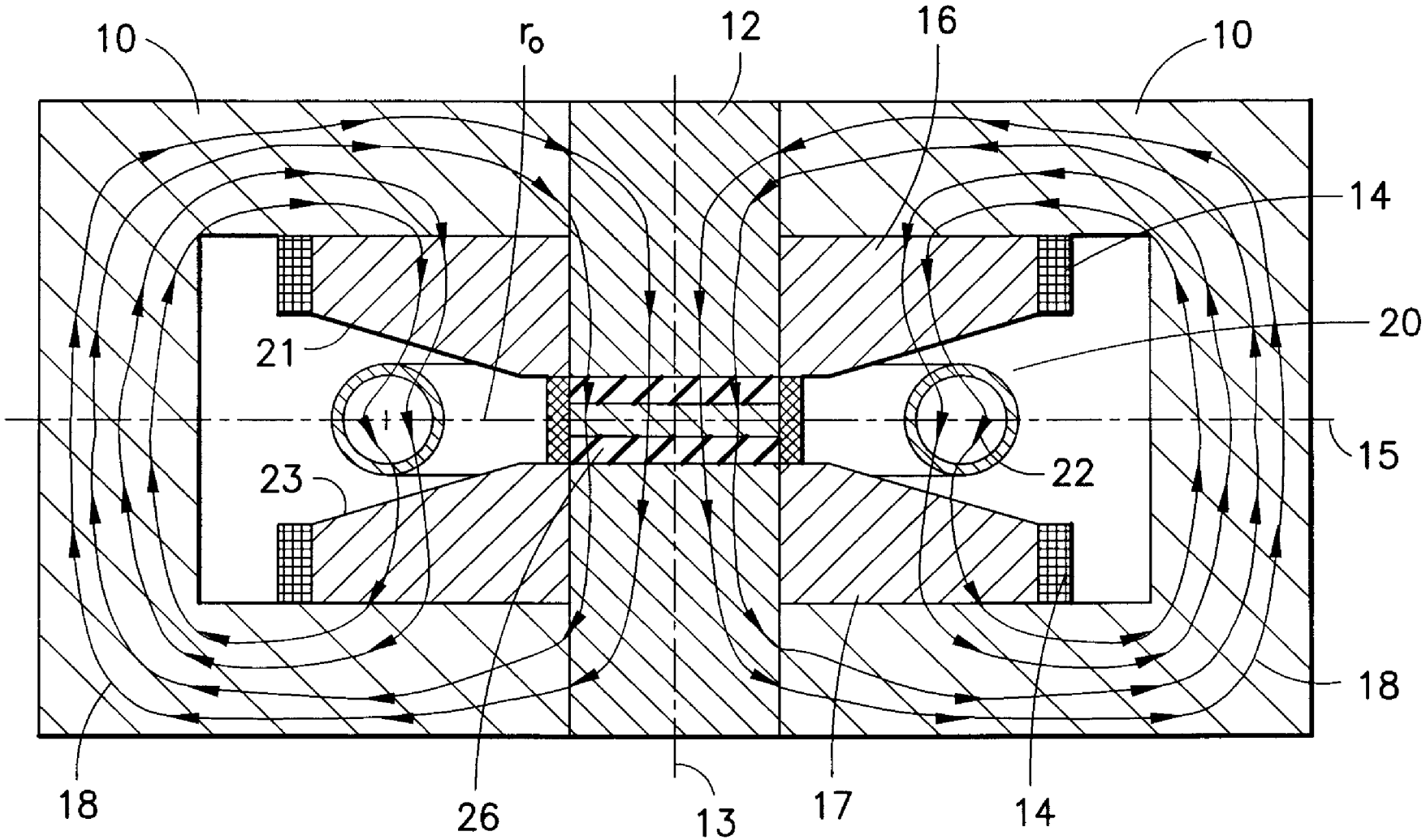
FIG. 2 illustrates the magnet configuration of FIG. 1 showing magnetic flux lines generated by the drive coil according to an aspect of the invention.

FIG. 2. illustrates the betatron magnet with flux lines 18 illustrating the magnetic field created by energizing the main drive coil 14.

Figure 3:
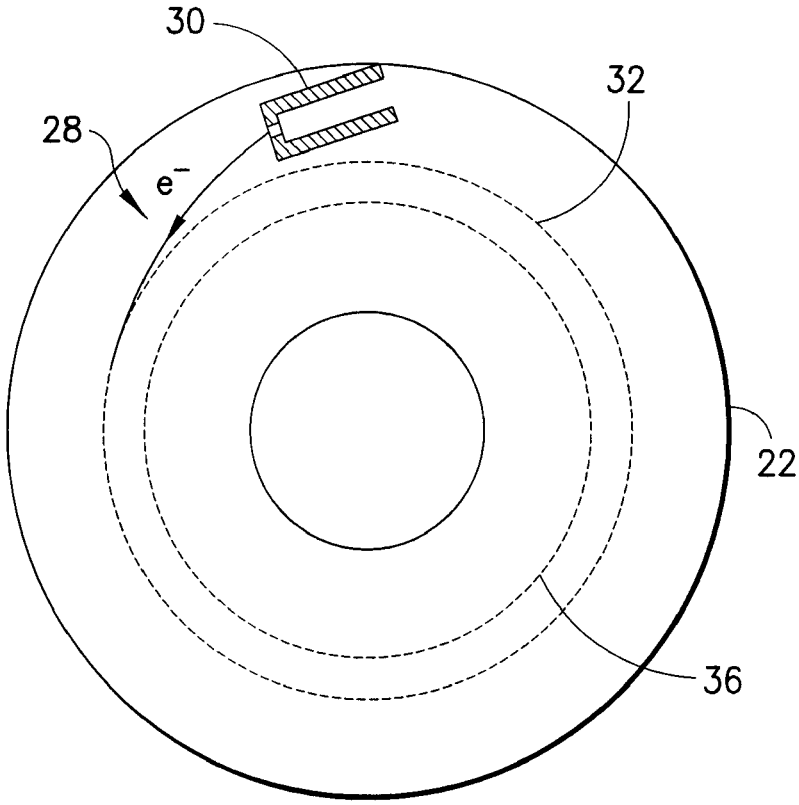
FIG. 3 illustrates a path for electrons injected into the betatron of FIG. 1 according to an aspect of the invention.

FIG. 3 illustrates the interior volume of the tube 22 in latitudinal cross section. Electrons 28 are injected into the volume from an electron emitter 30, such as a thermal emission dispenser cathode. For an electron 28 injected at a specific energy, there is a corresponding orbit at the instantaneous equilibrium radius, $r_i$ 32 such that the magnetic bending force is equal and opposite to the centrifugal force. An electron injected into the betatron magnet at a location either inside or outside $r_i$ 32 will exhibit a track having oscillatory motion about $r_i$ and this oscillation is referred to as the betatron oscillation. The betatron oscillation frequency is slower than the orbital frequency such that the electron completes one or more revolutions around the volume per betatron oscillation. As the magnetic field increases, the betatron oscillation amplitude reduces and $r_i$ 32 moves closer to the betatron orbit 36 $r_o$ (betatron damping) the terminus of the radius (22 in FIG. 1). To avoid hitting the injector 30 in a small betatron one needs to change $r_i$ at a faster rate than the intrinsic betatron damping rate.

Figure 4:
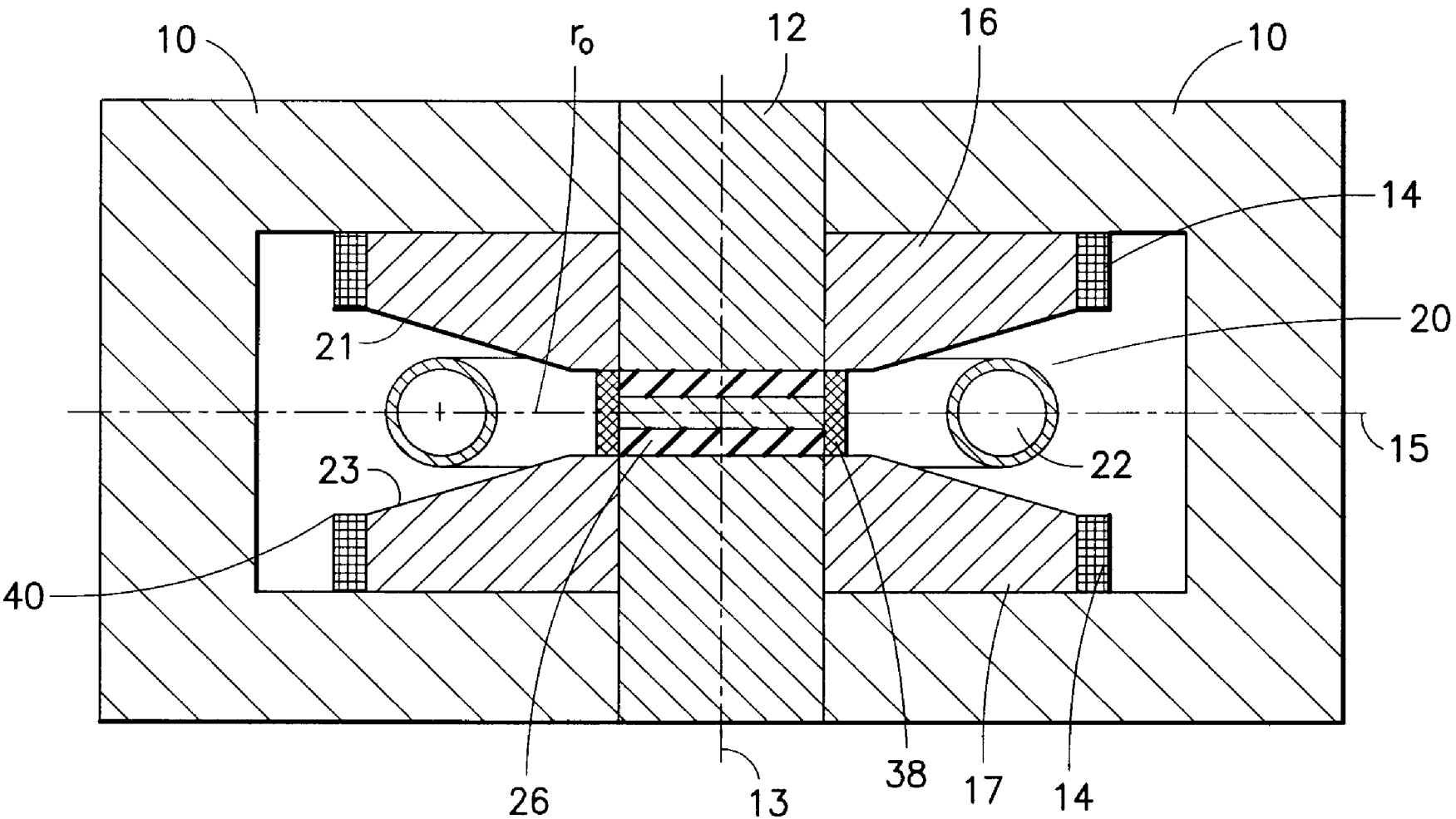
FIG. 4 illustrates in cross sectional representation the extraction coil and bias coil configuration of the betatron of FIG. 1 according to an aspect of the invention.

Referring to FIG. 4, unlike the 4.5 inch betatron of the prior art where charge trapping is effected by driving the core field and the guide field independently, to trap injected electrons inside a small betatron, and fill up the available volume inside the tube 22 defined by passageway 20, $r_i$ is manipulated by either reducing it (for injection near the outer fringe) or increasing it (for injection near the inner fringe) rapidly. Orbit contraction is achieved by either reducing the flux in the core 12 (decelerates electrons) or increasing the guide field in the orbital region (increases the bending force), or both. FIG. 4 demonstrates a method that includes a contraction coil 38 wrapped around a core gap 26 and can be connected in series but in opposite polarity with a bias coil 40. However, it is noted that the contraction coil portion and the bias control portion can be driven independently. Further, the combination of the contraction coil 38 and bias coil 40 (together referred to as the orbit control coil) is used to change both $\Delta\phi_0$ and $\Delta B_{y0}$ in the desired directions.

Figure 5:
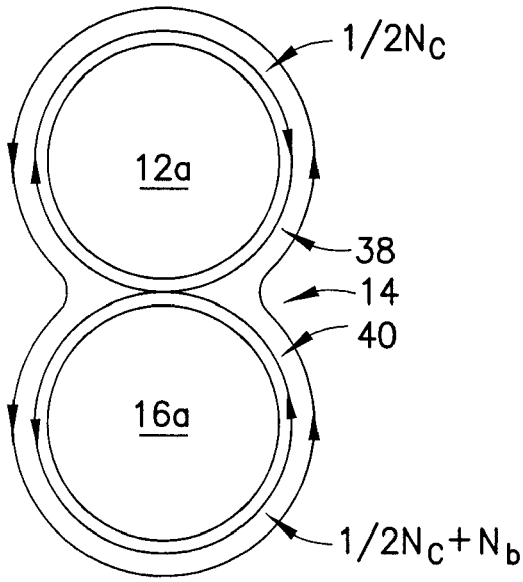
FIG. 5 illustrates a flux forcing arrangement where the extraction coil and bias coil are connected in series with opposite polarity according to an embodiment of the invention.

FIG. 5 is a conceptual illustration of the relationship between the orbit control coil 38,40 and the main drive coil 14. The area enclosed within the main drive coil and the bias coil is divided into a core section 12*a* and a guide magnet section 16*a*, with the contraction coil located exactly at the boundary between the two sections. The flux $\phi_{c,c}=aN_c i_c$ due to current $i_c$ flowing through the contraction coil must go through the core section 12*a*, where $N_c$ is the number of turns of the contraction coil and a is a design parameter that depends only on the geometry. This flux normally returns through the two return yokes since those paths have the lowest magnetic reluctance and links the main drive coil.

Still referring to FIG. 5, it's undesirable to have the contraction coil and the main drive coil linked because of induced voltages from one to the other. In order to realize low power consumption, the main drive 14 coil has many turns, typically ten or more. Consequently, a small voltage pulse on contraction coil will result in a high induced voltage on the main drive coil 14, which not only causes coil driver design complications but also counteracts against the contraction flux.

Also referring to FIG. 5, the bias coil 40 wound around the guide magnet 16*a* pole faces decouples the contraction coil from the main drive coil 14 by canceling the second magnetic flux in the return yokes. Since the bias coil 40 encloses both the core section 12*a* and the guide magnet section 16*a*, its flux $\phi_b$ may be expressed as the sum of fluxes in these two sections:

$$\phi_b=\phi_{b,c}+\phi_{b,g}=aN_b i_b+bN_b i_b=-aN_b i_c-bN_b i_c \tag{2}$$

where $N_b$ is the number of turns of the bias coil, b is a design parameter that depends only on the geometry, and $i_b=-i_c$ is the current flowing through the bias coil, which is the same as the contraction coil current (they may be connected in series or driven individually) but in opposite polarity. The bias condition (perfect cancellation of flux in the return yokes) is met when $$\phi_b+\phi_{c,c}=a(N_c-N_b)i_c-bN_b i_c=0 \tag{3}$$

or $$a(N_c-N_b)=bN_b \tag{4}$$

Since the right hand side must be positive, it follows that $N_c>N_b$

Due to limited space available around the core, it is desirable to have $N_c$ as small as possible. A small $N_c$ also leads to a low inductance which is essential for achieving a fast contraction speed. Since $N_b$ must be at least one turn, the minimum number of turns for $N_c$ is 2. This happens if the magnet is designed so that a=b. This condition is referred to as equal flux partition since the flux due to the bias coil is equally partitioned between core section 12*a* and guide magnet section 16*a*. The same holds true for the flux from the main drive coil. The magnet is designed so that flux equal partition is consistent with the betatron condition.

Still referring to FIG. 5, the second magnetic flux through the core section 12*a* due to the combined contraction coil and bias coil (together referred to as the orbit control coil) is $\frac{1}{2}\phi_{c,c}$ and returns through the guide magnet section 16*a*. Since the second magnetic flux is only half of $\phi_{c,c}$, the apparent inductance of the orbit control coil is ½ of the contraction coil inductance. The low inductance is crucial for achieving a high orbit contraction speed.

Also referring to FIG. 5, because the contraction coil and the bias coil are connected in opposite polarities, one of the two turns of the contraction coil may be considered as the reverse winding of the bias coil, and together they link only guide magnet section 16*a* in first polarity, whereas the other remaining turn in the contraction coil links only the core section 12*a* in second polarity. Together, the contraction coil and the bias coil form a FIG. 8 configuration as shown in FIG. 5. The fluxes in core section 12*a* and guide magnet section 16*a* are of the same magnitude but in opposite polarities and the flux change may be expressed as:

$$\Delta\phi_{12a}=-\Delta\phi_{16a} \tag{5}$$

and $$\Delta\phi_{12a}+\Delta\phi_{16a}=0. \tag{6}$$

Since the main drive coil 14 encloses both regions, the net flux linkage between the main drive coil and the orbit control coil is zero, and there is no interference from one coil to the other.

Figure 6:
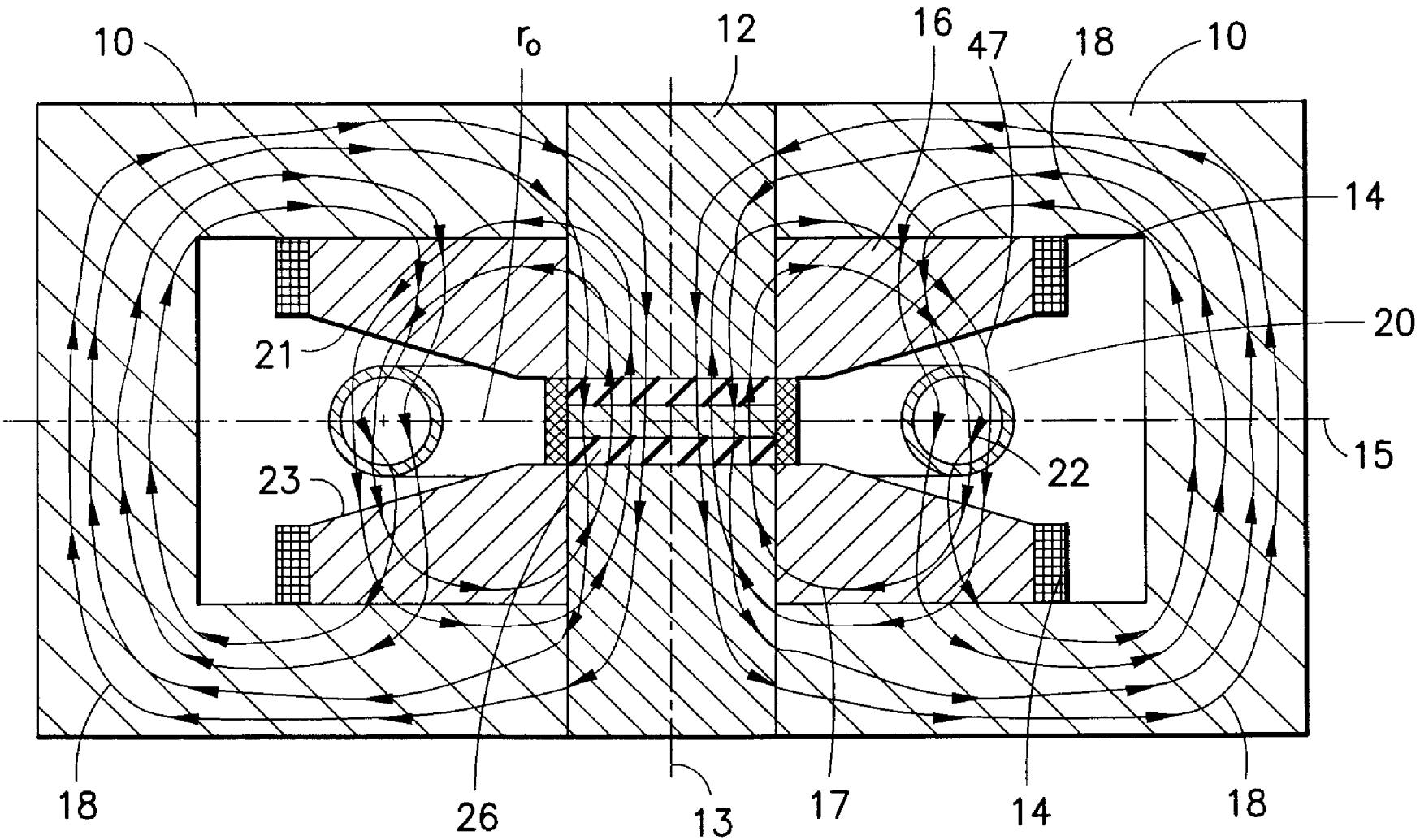
FIG. 6 illustrates magnetic flux associated with the betatron of FIG. 1 according to an aspect of the invention.

Referring to FIG. 6, the contraction flux 47 induces a fast deceleration electric field around the orbital region and an increase in the guide magnetic field on top of the slow rising guide magnetic field due to the main drive coil flux 18. As an electron slows down in relationship to the guide field, its instantaneous equilibrium orbit contracts and the electron moves away from the injector located near the outer edge of the pole faces. For a three inch betatron with 5 kV injection energy, the electrons are decelerated at a rate of approximately 250V per revolution to steer them clear of the injector. The orbit control coil is activated only for short periods of time, during electron injection and electron extraction. Between electron injection and extraction, the orbit control coil is shorted, referred to as the flux forcing state. In the flux forcing state the orbit control coil enforces flux equal partition condition of the main drive coil, whereby enforcing a flux forcing condition hence is the betatron condition. For example, if a portion of the core saturates during acceleration, the burden of carrying that portion of the flux is shifted to the remaining core due to an induced current in the orbit control coil.

Still Referring to FIG. 6, in reducing the betatron size, the magnetic core 12 has a reduced diameter. Were the core formed from ferrite, as were cores for the prior art betatrons, there could be a loss of end point energy due to a smaller flux change. This energy may be restored by using a material that has a higher saturation flux than ferrite. However, there are two drastically different time scales involved in the operation of a small diameter betatron. One involves acceleration of electrons to their end point energy after they have been trapped in stable orbits. The acceleration to full energy typically takes about 30 μs. The other, shorter, time scale involves trapping electrons after they leave the injector and before they are lost. The window during which successful trapping is typically less than 100 ns. Suitable high flux density materials are considerably slower than ferrite. Although they are sufficient for acceleration, they are too slow for the trapping process.

Figure 7:
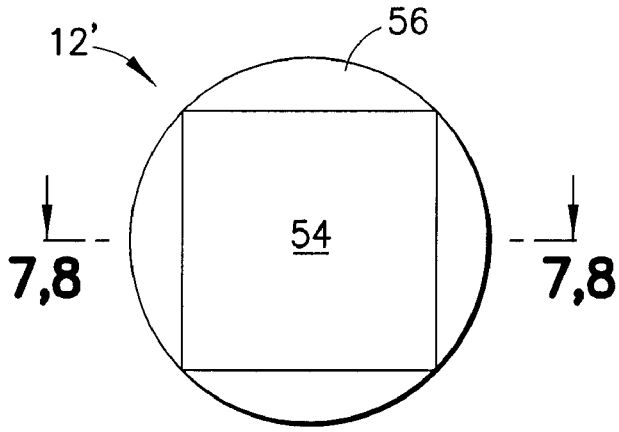
FIG. 7 illustrates an alternative magnetic core in top planar view according to an embodiment of the invention.
Figure 8:
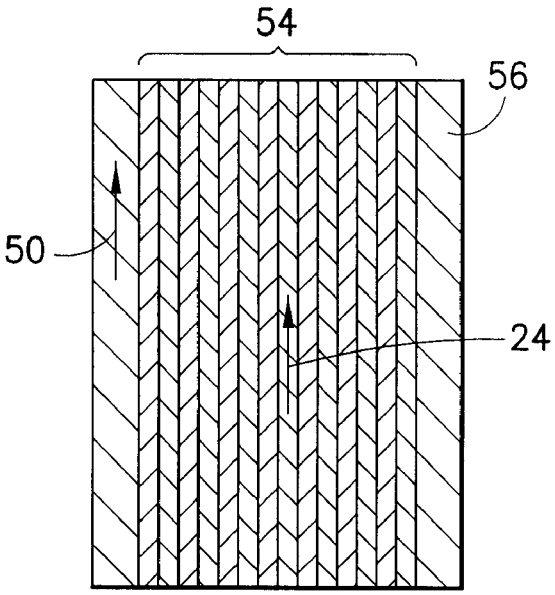
FIG. 8 illustrates the magnetic flux in the magnetic core of FIG. 7 prior to saturation of a core component according to an aspect of the invention.
Figure 9:
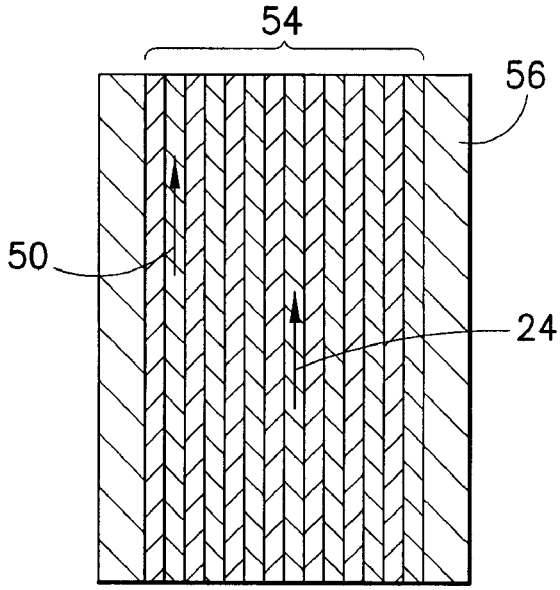
FIG. 9 illustrates the magnetic flux in the magnetic core of FIG. 7 after saturation of the core component according to an aspect of the invention.

A hybrid core 12' as shown in top planar view in FIG. 7, has a central portion 54 formed from an amorphous metal, for example a Metglas (manufactured by Hitachi Metal of Conway, S.C.) surrounded by arcuate pieces 56 of high speed ferrite. The Metglas block has a high saturation flux density and carries the bulk of the accelerating flux, while the high speed ferrite pieces provide the fast switching speed needed during electron injection. With reference to FIG. 8, the ferrite pieces 56 provide the flux swing 50 used to rapidly contract the electron orbits while the slower amorphous metal of the central portion 54 provides the flux 24 necessary for accelerating electrons to full energy. Since the total flux swing during electron trapping is quite small, only a small amount of ferrite is needed. Referring to FIG. 9, after successful trapping, the ferrite pieces 56 saturate without a detrimental effect and the amorphous metal central portion 54 takes over and continues to accelerate electrons to the desirable energy. Normally, saturation of a portion of the core would cause the main drive coil flux to redistribute between 12*a* and 16*a* and breakdown of the betatron condition. However, with the orbit control coil in flux forcing state, deviation from flux equal partition is not possible and beam loss avoided. Once electrons have reached the desirable energy a surge of current in the proper direction through the contraction and bias coils causes the electron beam to accelerate faster in relationship to the magnetic field thus moving the beam trajectory out to the target.

Still referring to FIG. 9, like most high flux density materials, the amorphous metal central portion is a laminated core. The lamination introduces undesirable anisotropy in the core geometry. The ferrite pieces 56 around the core 54 shield the orbital region from the anisotropy during the critical initial acceleration phase. Once the electrons gain sufficient energy, they are much less susceptible to perturbations in the magnetic field.

Figure 10:
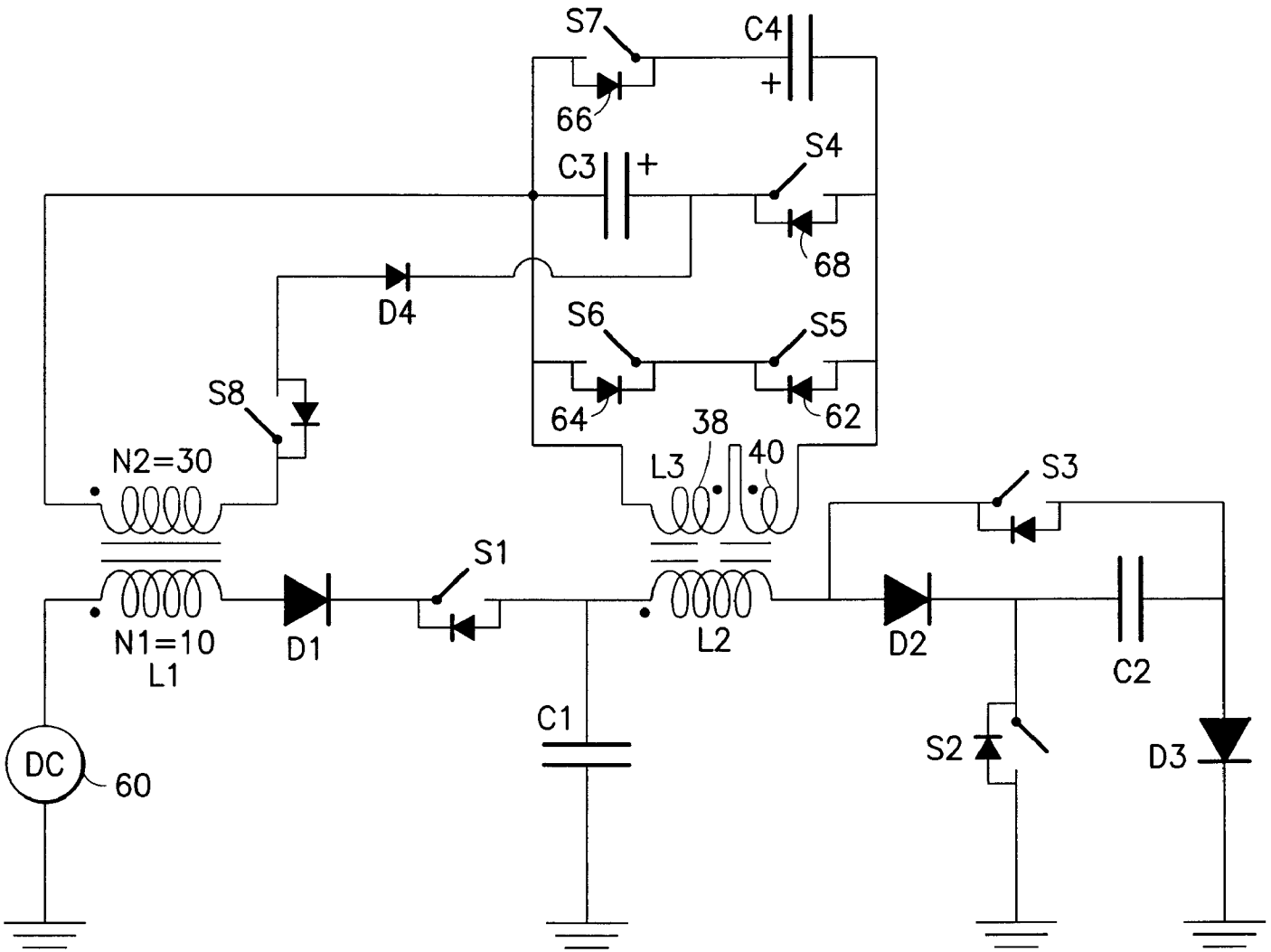
FIG. 10 schematically illustrates a circuit to drive a small betatron according to an embodiment of the invention.

FIG. 10 schematically illustrates a modulator circuit to drive a small betatron. If used for borehole logging, the available power 60 typically comes from a logging truck in the form of DC low voltage with a current of less than 1 Amp. The small betatron requires a pulsed source with a nominal peak current of 170 A and nominal peak voltage of 900V. The modulator circuit is effective to convert the low voltage, low current DC power into a high voltage, high current, pulsed power in an efficient way. The concept for driving the main coil 14 (L2 in FIG. 10) was disclosed in U.S. Pat. No. 5,077,530 to Chen et al. U.S. Pat. No. 5,077,530 is incorporated by reference in its entirety herein. FIG. 10 expands the concepts of U.S. Pat. No. 5,077,530 and illustrates an implementation of the orbit control concept disclosed in the present invention.

Still referring to FIG. 10, the main drive coil L2 is connected in series with capacitors C1 and C2 where the capacitance of C1 is much greater (on the order of 100 times or more greater) than the capacitance of C2 forming a modified LC discharge circuit. When switch S1 is initially pulsed closed, the low voltage DC power supply 60 charges capacitor C1 through a charging choke L1. The high voltage capacitor C2 is initially charged to the same voltage. Energy in C1 is then transferred to C2 in subsequent pulses. The energy transfer occurs in two stages. In the first stage, switches S2 and S3 are closed and energy flows from both capacitors C1, C2 into the betatron drive coil L2. Once the energy in the betatron magnet reaches its maximum, switches S2 and S3 open simultaneously and energy flows to high voltage capacitor C2 through diodes D2, D3. In this way, the betatron functions as a fly-back auto-transformer.

After each discharge-recovery cycle, the energy in low voltage capacitor C1 is replenished through the charging choke L1 by closing switch S1. As the voltage of C2 builds up, the energy discharged in each pulse increases and so does the total circuit loss. After a few pulses, the energy discharged from C1 becomes equal to the total loss in the circuit and no more energy is transferred. Henceforth, the voltage of C2 remains unchanged before and after each discharge-recovery cycle and the modulator has reached its normal operating state.

Also referring to FIG. 10, C1 and C2 are connected in series with C1 having a much greater capacitance than C2. The effective capacitance of the LC circuit is C, which is about equal to C2. If the inductance of L2 is nominally 134 μH, then the excitation energy is $\frac{1}{2}(L2)(I2)^2$ which is about equal to $\frac{1}{2}(C2)(V2)^2$ or about 1.9 joule when I2 is about 170 A. Reducing C2 results in a shorter discharge and recovery period and reduced loss, but requires a higher voltage. The maximum voltage is limited by the breakdown voltages of the solid state switches and diodes. Also, C1 must be large enough for a sufficient voltage gain. Effective values for C1 and C2 are nominally 600 μf and 5 μf, respectively.

For a 1.5 MeV beam, a modulator circuit efficiency of 90% and 400 W average power, the discharged energy per pulse is about 2 joule, V1 is about 40V, V2 is about 900V and the pulse frequency is about 2 kHz.

Referring to FIG. 10, the orbit control coil L3 includes extraction coil 38 and bias coil 40. The orbit control coil performs three functions, orbit contraction during electron injection, flux forcing during acceleration and orbit expansion during beam extraction. The contraction voltage pulse requires a fast cut-off, but not much energy, so capacitor C4 may be small, nominally 0.015 μf with a stored voltage of between 200 and 300 volts. C3 is a larger capacitor, on the order of 5 μf, to store the energy required to expand the orbit of the 1.5 MeV beam. The voltage of C3 is between about 120 and 150 volts. The driver for the orbit control coil L3 draws its energy from the same charging choke L1 as the main driver circuit. However, its input impedance is much higher such that when S1 is closed, most energy flows to C1 instead of C3. To divert energy flow to C3, S1 is turned off. The timing of S1 together with the charging voltage level effects control of the voltages in both C1 and C3. Part of the energy in C3 is transferred to C4 by turning on S4 at the proper time, in much the same way as energy is transferred from C1 to C2.

Further, FIG. 10 shows the orbit control timing sequence is initiated by switching S6 to the conduction state. When the injection energy matches the local magnetic field, S7 closes and the voltage of C4 is imposed on the control coil L3. This initiates the orbit contraction process. After a short delay, nominally less than 1 μs, S7 opens and the current in L3 continues to flow through S6 and the body diode 62 of S5. At this point, S5 is switched on and since S5 and S6 are both conducting, the control coil L3 is essentially shorted in both directions. The voltage across L3 drops to about 1 volt due to the forward voltage drops of the diode and other ohmic drop. Because the control coil L3 is shorted, the core flux change must be equal to the guide magnet flux change at all times, even if a portions of the core and pole faces are saturated. This is referred to as the control coil being in the flux forcing state. In essence, a shorted control coil enforces the equal partition of flux between the core section 12*a* and the guide magnet section 16*a*. If for any reason (e.g. partial saturation in a portion of the magnet) the fluxes in guide magnet section 16*a* and core section 12*a* deviate from the equal partition condition, a current is induced in the orbit control coil to restore the condition. Since flux equal partition is consistent with the betatron condition, enforcing it also guarantees the betatron condition is satisfied at all time.

Referring to FIG. 10, the flux forcing state is of little or no consequence when the flux density is low. However, as the flux density increases, the ferrite pieces in the core and at the lips at the outer rim of the pole faces saturate. Without the control coil L3 to enforce the proper flux partition condition, the betatron condition soon breaks down and the beam is lost before reaching 1.5 MeV. When the control coil L3 is in the flux forcing state, the current in L3 decreases slowly and eventually it changes direction. At this point, S6 can be switched off without any detrimental effect since the current is flowing through its body diode 64. At the peak of the main drive coil L2 current, where the beam is approximately 1.5 MeV, S4 closes and S5 opens. This changes the polarity of the current flow through L3 and the electron orbits start to expand. The minimum amount of energy required is such that all the electrons are swept out to the target at the peak of the control coil L3 current while the voltage in C3 is zero. After the peak, the current decays and the voltage in C3 builds up in reverse polarity. At the proper time, while the control current is still in the same direction, S4 opens and the remaining energy in L3 is transferred to C4 through the body diode 66 of S7. Because C4 is much smaller than C3, the current drops rapidly and eventually changes its polarity, at which point charging of C4 ceases. The current now flows back to C3 through the body diode 68 in S4 and the voltage in C3 is restored to the proper polarity. After all energy has been returned to C3, it is recharged through the choke L1 and ready for the next pulse.

One or more embodiments of the present invention have been described. Nevertheless, it will be understood that various modifications may be made without departing from the spirit and scope of the invention. For example, placing the injector on the inside of the passageway. It is noted that the foregoing examples have been provided merely for the purpose of explanation and are in no way to be construed as limiting of the present invention. While the present invention has been described with reference to an exemplary embodiment, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A betatron magnet, comprising:

a first guide magnet having a first pole face and a second guide magnet having a second pole face and both said first guide magnet and said second guide magnet having a centrally disposed aperture, wherein said first pole face is separated from said second pole face by a guide magnet gap;

a core disposed within said centrally disposed apertures, in an abutting relationship with both said first guide magnet and said second guide magnet, said core having at least one core gap;

a drive coil wound around said first pole face and said second pole face;

an orbit control coil having a contraction coil portion wound around said at least one core gap and a bias coil portion wound around both said first pole face and said second pole face, said contraction coil portion and said bias coil portion are connected but in opposite polarity;

wherein magnet fluxes in said core and said first and said second guide magnets return through one or more peripheral portions of the betatron magnet;

a circuit effective to provide voltage pulses to said drive coil and to said orbit control coil; and an electron acceleration passageway located within said guide magnet gap.

2. The betatron of claim 1, wherein said core is a hybrid having a high saturation flux density central portion and a perimeter formed from a fast response highly permeable magnetic material.

3. The betatron of claim 2, wherein said central portion is an amorphous metal and said perimeter is a ferrite with a magnetic permeability in excess of 100.

4. The betatron of claim 2, wherein a cumulative width of said at least one core gap is effective to satisfy a betatron condition.

5. The betatron of claim 4, wherein said cumulative width of said at least one core gap is between 2 millimeters and 2.5 millimeters.

6. The betatron of claim 4, wherein said at least one core gap is formed of multiple gaps.

7. The betatron of claim 4, wherein diameters of both said first pole face and said second pole face are between 2.75 inch and 3.75 inch.

8. The betatron of claim 4, wherein a ratio of said contraction coil portion windings to said bias control portion windings is 2:1.

9. The betatron of claim 8, wherein a ratio of said drive coil windings to said bias coil windings is at least 10:1 and the number of drive coil windings is at least 10.

10. The betatron of claim 9, wherein said circuit provides a nominal peak current of 170 A and a nominal peak voltage of 900V.

11. The betatron of claim 10, affixed to a sonde effective for insertion into an oil well bore hole.

12. A method to generate x-rays, comprising the steps of:

providing a betatron magnet that includes a first guide magnet having a first pole face and a second guide magnet having a second pole face and both said first guide magnet and said second guide magnet having a centrally disposed aperture, wherein said first pole face is separated from said second pole face by a guide magnet gap and a core disposed within said centrally disposed apertures, in an abutting relationship with both said first guide magnet and said second guide magnet, said core having at least one core gap;

circumscribing said guide magnet gap with an electron passageway;

forming a first magnetic flux of a first polarity to an opposing second polarity and that passes through central portions of said betatron magnet and said core as well as through said electron passageway and then returns through peripheral portions of said betatron magnet;

injecting electrons into an electron orbit within said electron passageway when said first magnetic flux is at approximately a minimum strength at said first polarity;

forming a second magnetic flux at said opposing second polarity that passes through a perimeter of said core and returns through said electron passageway in a first polarity for a first time effective to compress said injected electron orbits to an optimal betatron orbit, wherein after said first time said perimeter of said core magnetically saturates and said second magnetic flux passes through an interior portion of said core and in combination with said first magnetic flux, accelerates said electrons whereby enforcing a flux forcing condition; and reversing the polarity of said second magnetic flux when said first magnetic flux approached a maximum strength thereby expanding said electron orbit causing said electrons to impact a target causing an emission of x-rays.

13. The method of claim 12, wherein said first magnetic flux is formed by energizing a drive coil wound around both said first pole face and said second pole face.

14. The method of claim 13, wherein said second magnetic flux is formed by energizing a contraction coil wound around said at least one core gap.

15. The method of claim 14, wherein a return portion of said second magnetic flux in said peripheral portions of said betatron magnet is cancelled by a flux generated by a bias coil wound around both said first pole face and said second pole face.

16. The method of claim 15, wherein said bias coil is electrically connected in series, but at opposite polarity, to said contraction coil.

17. The method of claim 16, wherein a ratio of bias coil flux to second flux is effective to cause said second flux to return through said electron passageway.

18. The method of claim 17, wherein a ratio of contraction coil windings to bias coil windings is 2:1.

19. The method of claim 17, including forming said core as a hybrid having a high saturation flux density interior and a fast response permeable perimeter.

20. The method of claim 19, wherein said first time is on the order of 100 nanoseconds.

21. The method of claim 20, wherein a time from minimum strength at said first polarity to maximum strength at said first polarity is on the order of 30 microseconds.

22. The method of claim 17, wherein said first magnetic flux and said second magnetic flux are effective to accelerate said electrons to in excess of 1 MeV.

23. The method of claim 17, wherein a ratio of said drive coil windings to said bias coil windings is 10:1.

24. The method of claim 23, wherein said drive coil is driven by a modulating circuit that provides a cycling voltage with a nominal peak current of 170 A and nominal peak voltage of 900V.

25. The method of claim 24, wherein said voltage cycles at a nominal rate of 2 kHz.

26. The method of claim 25, wherein said orbit control coil is pulsed to 120-150 volts during electron orbit expansion or contraction and shorted during electron acceleration.

27. The method of claim 22, wherein said x-rays are directed at subsurface formation formations access via an oil well bore hole.

28. The method of claim 12, wherein shorting an orbit control coil is effective to enforce said flux forcing condition.

* * * * *